US005765618A

United States Patent [19]

Toledano

[11] Patent Number: 5,765,618

[45] Date of Patent: Jun. 16, 1998

[54] ARTICULATION ARRANGEMENT FOR THE HANDLE OF A HANDBAG

[75] Inventor: Sidney Toledano, Neuilly, France

[73] Assignee: Christian Dior Couture, Paris, France

[21] Appl. No.: 811,423

[22] Filed: Mar. 5, 1997

[30] Foreign Application Priority Data

Mar. 6, 1996 [FR] France ..... 96 02836

[51] Int. Cl.[6] ..... A45C 1/02; A45C 3/06; A45C 13/22; A45C 13/26

[52] U.S. Cl. ..... 150/107; 150/104; 190/116

[58] Field of Search ..... 16/112 R, 115, 16/114 R; 294/27.1; 190/39, 115–118; 150/104, 107

[56] References Cited

U.S. PATENT DOCUMENTS

| | | | |
|---|---|---|---|
| 124,934 | 3/1872 | Chapman | 190/116 |
| 1,113,821 | 10/1914 | Partmann | 190/118 X |
| 1,129,967 | 3/1915 | Eiseman | 190/115 |
| 1,855,358 | 4/1932 | Maksik | 150/107 |
| 5,178,198 | 1/1993 | Fitzgerald | 190/116 X |

FOREIGN PATENT DOCUMENTS

| | | | |
|---|---|---|---|
| 446807 | 9/1991 | European Pat. Off. | 150/107 |

*Primary Examiner*—Sue A. Weaver
*Attorney, Agent, or Firm*—Dennison, Meserole, Pollack & Scheiner

[57] ABSTRACT

The present invention relates to an articulation device configured to ensure a link between a gripping handle and a handbag by providing an eyelet in a wall of the handbag and a ring which has an opening sufficient to be placed over the wall and through the eyelet and a device for closing the ring, thereby enabling rotational movement of the ring relative to the eyelet.

7 Claims, 2 Drawing Sheets

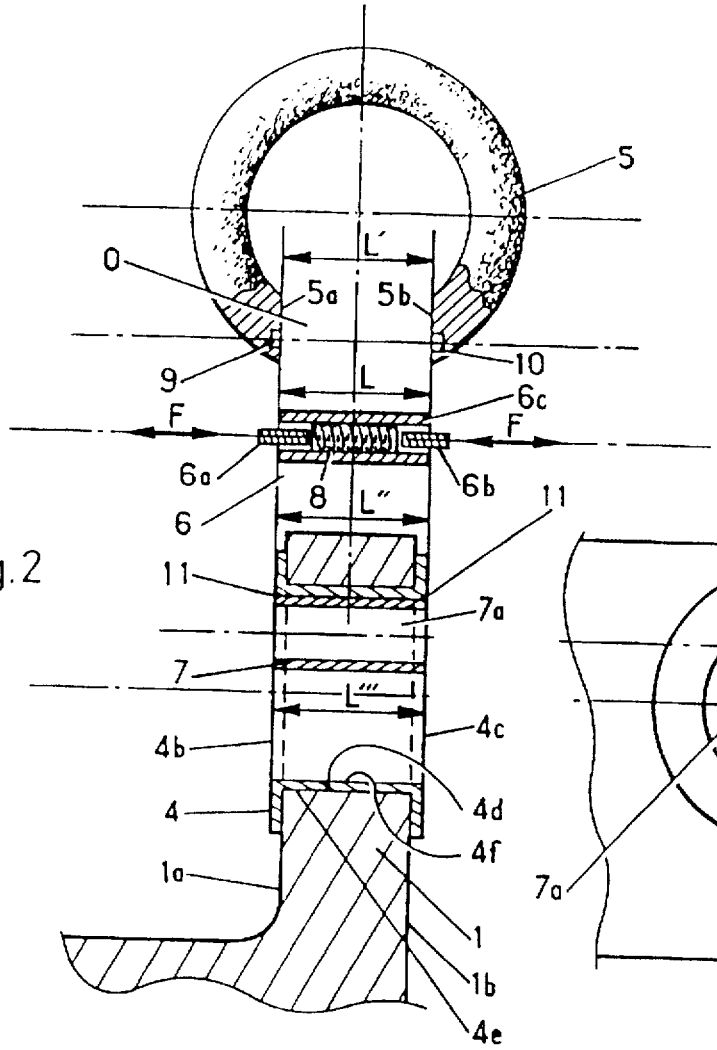
Fig.2
Fig.3
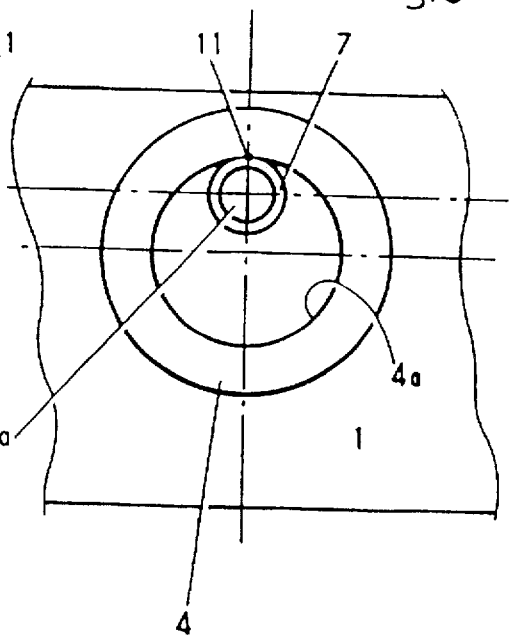
Fig.4
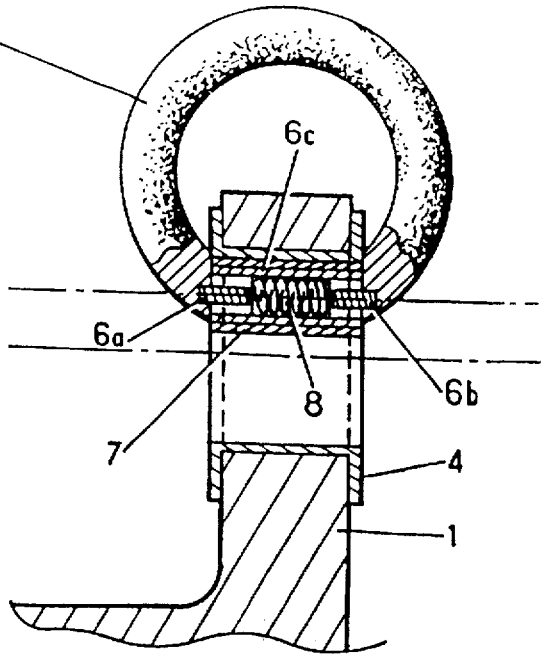

ARTICULATION ARRANGEMENT FOR THE HANDLE OF A HANDBAG

BACKGROUND OF THE INVENTION

The invention concerns an articulation means designed to provide a link between at least one end of a holding component, such as a handle and a handbag or similar item of luggage, by means of a ring connecting an eyelet in the wall of the handbag, wherein the ring is able to move freely so as to rotate.

The main inconvenience of this type of arrangement lies in the fact that the ring is closed upon itself in a known manner and is arranged to move freely and in all directions within the eyelet in the manner of two links of a chain. A rapid deterioration of the two contact surfaces of the ring and of the eyelet ensue leading not only to the aesthetic deterioration of the assembly, but in the event of intense use, sometimes leading to the ring breaking as a result of wear.

OBJECT OF THE INVENTION

Such an inconvenience is understandably not tolerated by the manufacturers of that type of article and more particularly, when dealing with luxury articles, such as top of the range handbags, which owe to themselves a particular performance in time to the satisfaction of the customer and at the same time, to the brand image of the creator and manufacturer.

The aim of the present invention is to achieve this objective by finding a solution to the aforementioned problem.

SUMMARY OF THE INVENTION

The invention concerns an articulation arrangement intended to ensure the link between at least one end of a gripping device, such as a handle or the like, and a handbag or similar item of baggage, by means of an eyelet linking the wall of the bag, characterized in that a connecting ring is initially open and has a means of subsequent closure consisting of a removable pin device allowing free insertion into a matching sheath which is secured inside the eyelet for the purpose of the cooperation of the pin device free ends with the corresponding ends of the open ring after the ring has been placed as a rider over the edge of the wall of the bag and at opposite sides of the eyelet.

In that way, it will be easily understood that the pin device is freely movable in a transverse direction only and no longer in all directions as previously known, thereby limiting the aforementioned deterioration. Deterioration can only occur inside the sheath, thus being invisible and ineffective with regard to the outer appearance of the eyelet and of the ring. This is likely to preserve the good appearance of the bag.

In addition, the pin device is removable and serves as a wear component which may be easily replaced if necessary without affecting the other components.

BRIEF DESCRIPTION OF THE DRAWINGS

FIG. 2 shows a transverse section view of the articulation arrangement according to FIG. 1.

FIG. 3 shows a front view of part of the bag according to FIG. 2 before the fitting of the articulation arrangement.

FIG. 4 shows a transverse sectional view of an articulation arrangement according to FIG. 2, after the affixing to a bag.

DETAILED DESCRIPTION OF THE INVENTION

Figure 1:
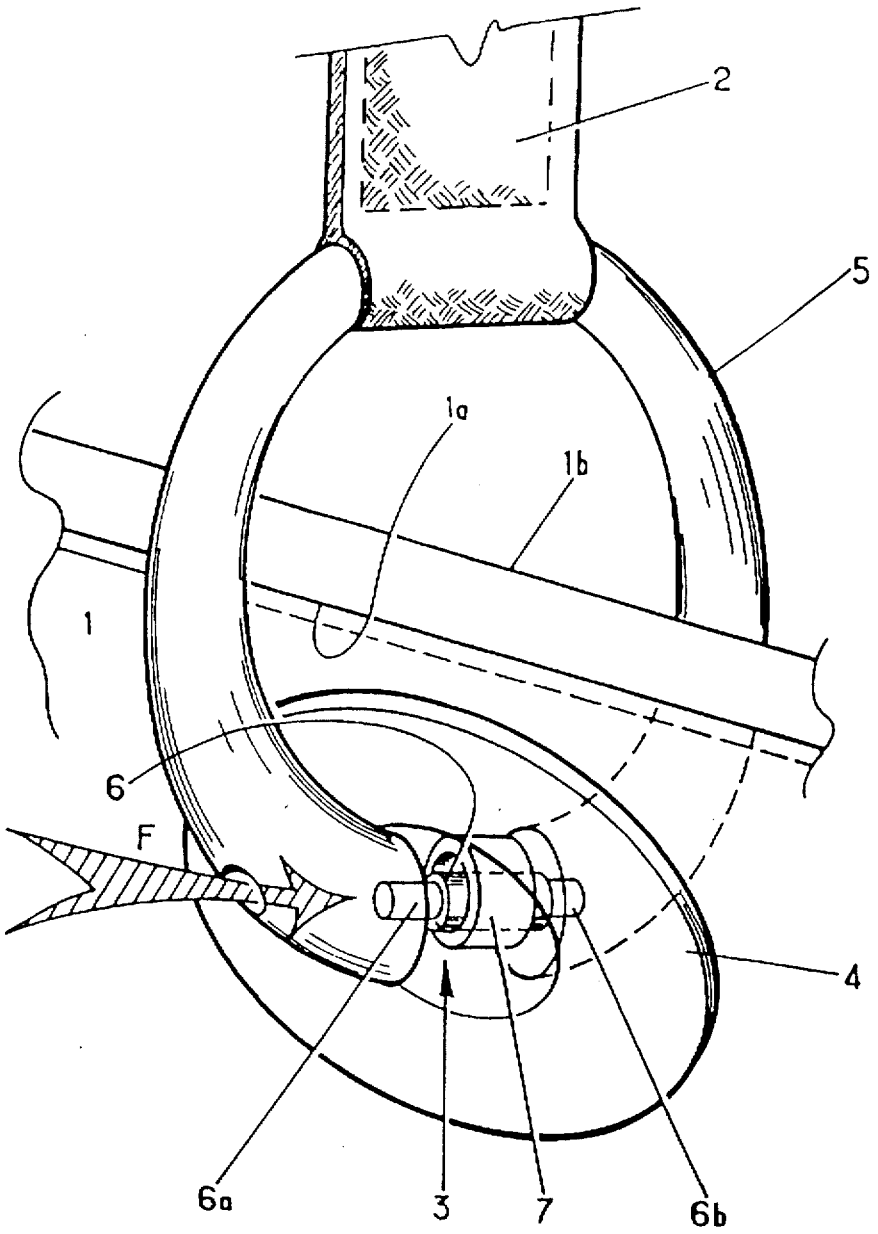
FIG. 1 shows a perspective view of an articulation arrangement in position on a piece of luggage according to the invention.

The following description of a preferred example will allow a better understanding of the manner in which it is possible to achieve the invention.

The handbag partly illustrated in the figures comprises at least a wall 1 on which a gripping component is to be fitted, in this case, a handle 2, by means of an articulation arrangement 3 designed to cooperate with an eyelet 4 affixed through a wall 1 of the bag.

The articulation arrangement 3 comprises a ring 5 connecting the free end of the handle 2 to the eyelet 4 in which the ring can freely rotate.

According to the invention, the connection ring 5 is open and has ends **5*a*, 5*b*. A means of subsequent closure which consists of a removable pin device 6 is inserted into a matching sheath 7 which is affixed to the inside of the eyelet 4, as shown in FIG. 3. As shown in FIGS. 1 and 2, the pins 6*a*, 6*b* extend into the corresponding ends 5*a*, 5*b* of the open ring 5, after the ring has been placed as a rider over the edge of the wall of the bag at opposite sides of the eyelet 4**.

Preferably, the pin device 6 for allowing movement and closure of the ring 5 includes a hollow shaft or tubular body **6*c* of a length L effectively corresponding with the length L' of the opening of the ring 5. Inside the tubular body is located a compression spring 8 causing a push action F upon two opposing pins 6*a* and 6*b*. These pins located at each of the spring ends slide freely within the hollow body 6*c* so that they may be pushed inside it to allow the insertion of the pin device 6 in the aperture of the ring 5 after passing through the sheath 7 which is formed integral with an inner part 4*a* of the eyelet 4 to anchor the pins 6*a*, 6*b* in two matching openings 9 and 10 provided at the ring ends 5*a*, 5*b*** to assume their extended position.

To facilitate the rotation of the pin device 6 inside the sheath 7 is a length of cylindrical tubing having an internal diameter greater than the external diameter of the pin device 6 it receives.

As shown in the illustrations, and more particularly in FIG. 4, the sheath 7 is secured inside the eyelet 4 in an eccentric manner in the upper part.

The sheath 7 is secured to the eyelet 4 by means of spot welding 11. Obviously, all other means, such as bonding or simultaneous forming of the sheath 7 and the eyelet 4 by molding could be considered.

According to the present example of implementation, the eyelet 4 consists of two disks **4*b*, 4*c* clamping the wall 1 of the bag on each of its faces 1*a*, 1*b* and connected together by means of a central hollow cylindrical hub 4*d* of which the outer periphery 4*e* is intended to pass through a hole made in the wall 1 of the bag and of which the inner periphery 4*f* matches that of the inner part 4*a* of the eyelet 4** on which the sheath is affixed.

Finally, the total thickness L' of the eyelet 4, the length L'" of the sheath 7 fitted therein, the length L of the pin device 6 and the length L' of the opening of the ring 5 are practically identical except for allowing any necessary clearance.

I claim:

1. An articulation arrangement to ensure a rotatable link between at least one end of a gripping component and a handbag comprising: an eyelet affixed through a wall of the handbag, a ring connecting a free end of the gripping component with the eyelet to rotate freely with respect to the eyelet, wherein the ring is initially open and includes a component for subsequent closure, said component is a removable pin device designed to be freely inserted in a matching sheath which is affixed to an inside of the eyelet and including free ends which cooperate with matching ends of the open ring after the ring has been placed as a rider over an edge of the bag wall and at opposite sides of the eyelet.

2. The articulation arrangement according to claim 1, wherein the removable closure pin device for closure of the ring consists of a hollow tubular body having a length effectively matching the length of the opening of the ring and located within the tubular body, a compression spring and two opposing pins located at each end of the spring so as to freely slide within the tubular body which permits the pins to retract inside this hollow body to allow insertion of the pin device in the opening of the ring after having passed through the sheath which is formed integral with an internal part of the eyelet so as to anchor within two corresponding openings provided in the ends of the open ring.

3. The articulation arrangement according to claim 1, wherein the sheath is a length of cylindrical tube of which the internal diameter is greater than the external diameter of the pin device it receives.

4. The articulation arrangement according to claim 1, wherein the sheath is secured inside the eyelet at an eccentric position in an upper part of the eyelet.

5. The articulation arrangement according to claim 1, wherein the sheath is secured inside the eyelet by a weld.

6. The articulation arrangement according to claim 1, wherein the eyelet consists of two parallel disks clamping a wall of the bag on either face and said disks are connected together by means of a cylindrical central hub of which the external periphery is designed to pass through a hole made in the wall of the bag and of which the inner periphery matches that of the eyelet on which the sheath is affixed.

7. The articulation arrangement according to claim 1, wherein the total thickness (L") of the eyelet, the length (L'") of the sheath, the length L of the pin device, and the length (L') of the opening of the ring are practically identical except for any necessary clearance.

* * * * *